United States Patent [19]

Fischer et al.

[11] 4,111,099

[45] Sep. 5, 1978

[54] TWO-STAGE VACUUM MOTOR

[75] Inventors: Earl R. Fischer, Rochester; John A. Gural, Pittsford, both of N.Y.

[73] Assignee: General Motors Corporation, Detroit, Mich.

[21] Appl. No.: 785,779

[22] Filed: Apr. 8, 1977

[51] Int. Cl.[2] ..... F15B 11/18; F01B 7/20

[52] U.S. Cl. ..... 91/173; 91/189 R; 91/422; 92/94; 92/100

[58] Field of Search ..... 91/173, 189 R, 168, 91/357

[56] References Cited

U.S. PATENT DOCUMENTS

| | | | |
|---|---|---|---|
| 762,627 | 6/1904 | Fink | 91/168 |
| 2,986,125 | 5/1961 | Young et al. | 91/357 |
| 3,381,582 | 5/1968 | Golden | 91/357 |
| 3,657,966 | 4/1972 | Campbell | 91/357 |

*Primary Examiner*—Paul E. Maslousky
*Attorney, Agent, or Firm*—C. K. Veenstra

[57] ABSTRACT

A vacuum motor suitable for actuating a carburetor choke valve has primary and secondary stages responsive to separate vacuum signals. The secondary stage is carried by the primary stage and has a valve which opens upon full retraction of the primary stage to permit application of a vacuum signal to the secondary stage.

2 Claims, 3 Drawing Figures

TWO-STAGE VACUUM MOTOR

This invention relates to a two-stage vacuum motor which has a variety of potential applications and which is particularly suited for actuating a carburetor choke valve.

Numerous two-stage vacuum motors have been proposed heretofore; in general, however, use of a separate vacuum signal for each stage has required a complex structure having a separate vacuum responsive member for each stage. This invention provides a two-stage vacuum motor constructed to permit a single diaphragm to respond to two separate vacuum signals.

In a preferred embodiment, the two-stage vacuum motor provided by this invention has a single diaphragm, the inner portion of which acts as a secondary stage and is carried by the outer primary stage portion. The secondary stage has a valve which opens upon full retraction of the primary stage to permit application of a vacuum signal to the secondary stage.

The details as well as other features and advantages of this invention are set forth in the following detailed description of the preferred embodiment and are shown in the drawing in which.

Figure 1:
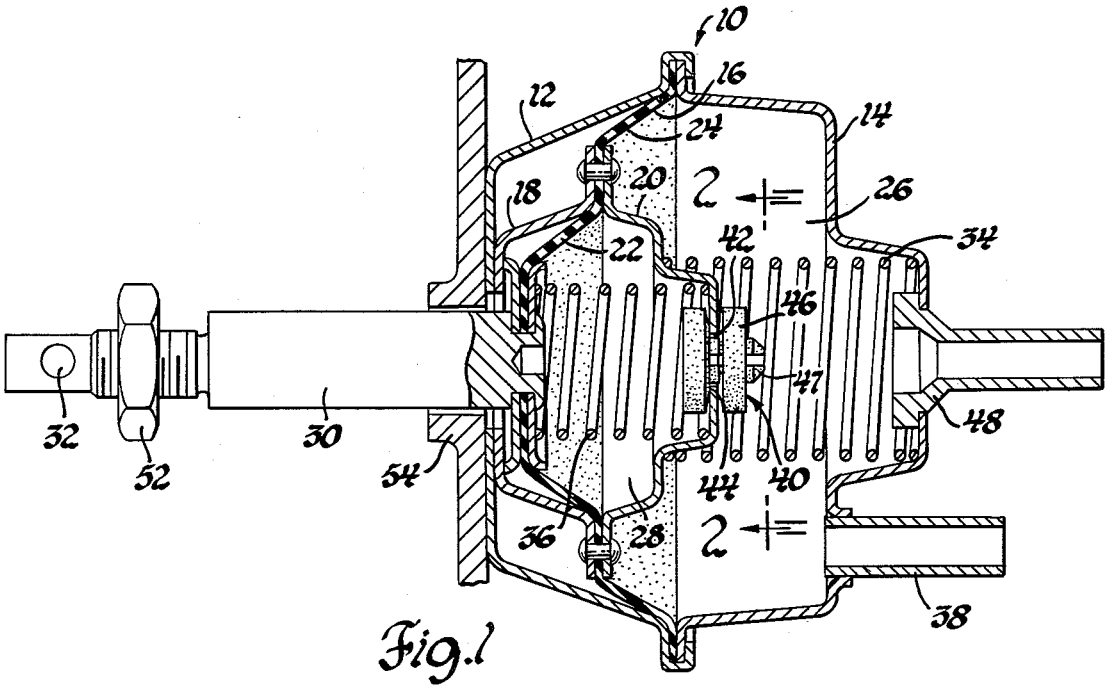
FIG. 1 is an axial sectional view of this two-stage vacuum motor.
Figure 2:
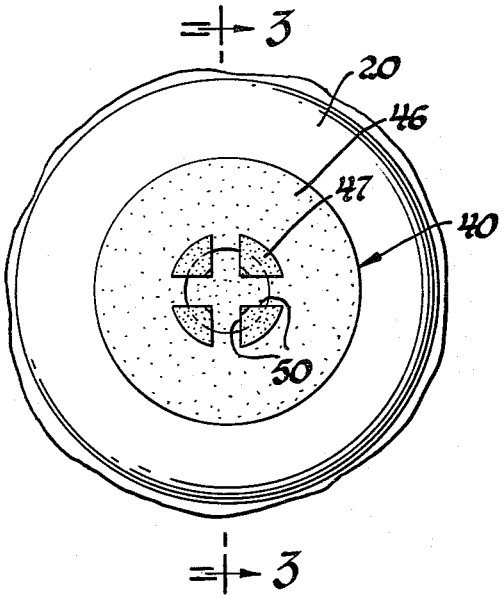
FIG. 2 is an enlarged view, taken generally along line 2—2 of FIG. 1, showing the end of the valve which controls application of the vacuum signal to the secondary stage.

Referring first to FIG. 1, a two-stage vacuum motor 10 has front and rear outer housings 12 and 14 secured on opposite sides of a diaphragm 16. Front and rear inner housings 18 and 20 are also secured on opposite sides of diaphragm 16 and separate diaphragm 16 into an inner portion 22 and an annular outer portion 24. A primary chamber 26 is defined between rear outer housing 14 and the annular portion 24 of diaphragm 16, while a secondary chamber 28 is defined between rear inner housing 20 and the inner portion 22 of diaphragm 16.

A stem 30 is carried by inner diaphragm portion 22, extends through front housings 18 and 12, and has an opening 32 adapted to receive a link for actuating a carburetor choke valve or other device.

An outer spring 34 biases front inner housing 18 into engagement with front outer housing 12, and an inner spring 36 biases inner diaphragm portion 22 into engagement with front inner housing 18.

In operation a primary vacuum signal is applied to primary chamber 26 through a primary vacuum fitting 38 included as part of rear outer housing 14. A valve 40, disposed in an opening 42 formed in rear inner housing 20 between primary chamber 26 and secondary chamber 28, is then drawn rightwardly by the pressure differential between chamber 28 and chamber 26 so that its sealing surface 44 engages rear inner housing 20 about opening 42 and the vacuum signal from primary fitting 38 is not applied to secondary chamber 28. Accordingly, the outer portion 24 of diaphragm 16 is retracted against outer spring 34 and carries inner housings 18 and 20 to partially retract stem 30 while inner spring 36 inhibits full retraction of stem 30.

Figure 3:
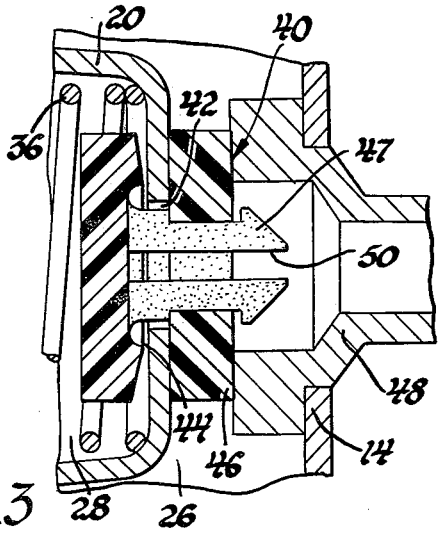
FIG. 3 is a sectional view, taken along line 3—3 of FIG. 2, showing how the valve opens upon full retraction of the primary stage.

As shown in FIG. 3, outer diaphragm portion 24 is retracted until a flange 46, carried on an extension 47 of valve 40, engages between rear inner housing 20 and a secondary vacuum fitting 48 included as part of rear outer housing 14. Upon engagement with fitting 48, flange 46 displaces sealing surface 44 from inner housing 20, allowing application of a vacuum signal from secondary fitting 48 to secondary chamber 28 through a plurality of slots 50 formed in valve extension 47. Inner diaphragm portion 22 is then retracted until an adjustable stop 52 carried on stem 30 engages a bracket 54. Bracket 54 is secured to front outer housing 12 for mounting vacuum motor 10.

The embodiments of the invention in which an exclusive property or privilege is claimed are defined as follows:

1. A two-stage vacuum motor comprising an outer housing, outer diaphragm means secured to said outer housing to form a primary chamber therebetween, an inner housing carried by said outer diaphragm means, inner diaphragm means secured to said inner housing to form a secondary chamber therebetween, a stem carried by said inner diaphragm means, primary and secondary springs respectively biasing said outer and inner diaphragm means away from said outer and inner housings, said inner housing having an opening from said secondary chamber to said primary chamber, and a valve biased to obstruct said opening and having an extension projecting toward said outer housing, said outer housing having a primary fitting for applying a vacuum signal to said primary chamber effective to retract said outer diaphragm means together with said inner housing and said stem against the bias of said primary spring, thereby engaging said valve extension with said outer housing to displace said valve from said opening, said outer housing having a secondary fitting which registers with said opening when said valve extension is engaged with said outer housing for applying a vacuum signal to said secondary chamber effective to further retract said inner diaphragm means and said stem against the bias of said secondary spring.

2. A two-stage vacuum motor comprising a pressure responsive diaphragm having an inner portion and an annular outer portion, front and rear inner housings secured on opposite sides of said inner portion of said diaphragm and forming a secondary chamber between said inner portion of said diaphragm and said rear inner housing, front and rear outer housings secured on opposite sides of said diaphragm and forming a primary chamber between said rear outer housing and said rear inner housing and said annular outer portion of said diaphragm, a stem carried by said inner portion of said diaphragm and extending through said front housing, an outer spring biasing said front inner housing into engagement with said front outer housing, an inner spring biasing said inner portion of said diaphragm into engagement with said front inner housing, said rear inner housing having an opening from said secondary chamber to said primary chamber, a pressure responsive valve having a sealing surface adapted to engage said rear inner housing about said opening when the pressure in said secondary chamber exceeds the pressure in said primary chamber, said valve further having a flange disposed between said rear housings, said rear outer housing having a primary fitting for applying a vacuum signal to said primary chamber effective to retract said outer portion of said diaphragm, said inner housings and said stem against the bias of said outer spring, thereby engaging said valve flange with said rear housings and disengaging said valve sealing surface from said rear inner housing, said rear outer housing also having a secondary fitting which registers with said opening when said valve flange is engaged with said rear housings for applying a vacuum signal to said secondary chamber effective to further retract said inner portion of said diaphragm and said stem against the bias of said inner spring.

* * * * *